US011536122B2

(12) United States Patent
Yokoyama et al.

(10) Patent No.: US 11,536,122 B2
(45) Date of Patent: Dec. 27, 2022

(54) OIL FIELD PUMP

(71) Applicant: MITSUBISHI HEAVY INDUSTRIES, LTD., Tokyo (JP)

(72) Inventors: Shimpei Yokoyama, Tokyo (JP); Nobuhiro Kunitake, Tokyo (JP); Takumi Hori, Tokyo (JP); Tanehiro Shinohara, Tokyo (JP); Norihisa Takei, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 388 days.

(21) Appl. No.: 16/793,386

(22) Filed: Feb. 18, 2020

(65) Prior Publication Data

US 2020/0378225 A1 Dec. 3, 2020

(30) Foreign Application Priority Data

May 31, 2019 (JP) ..... JP2019-102334

(51) Int. Cl.

| | |
|---|---|
| ***E21B 43/12*** | (2006.01) |
| ***F04C 13/00*** | (2006.01) |
| ***F04B 53/20*** | (2006.01) |
| ***F04D 13/08*** | (2006.01) |
| ***F04D 29/046*** | (2006.01) |
| ***F04D 29/041*** | (2006.01) |
| ***F04B 47/06*** | (2006.01) |

(52) U.S. Cl.

CPC ..... *E21B 43/128* (2013.01); *F04B 53/20* (2013.01); *F04C 13/008* (2013.01); *F04D 13/086* (2013.01); *F04D 29/046* (2013.01); *F04D 29/0413* (2013.01); *F04B 47/06* (2013.01)

(58) Field of Classification Search

CPC ..... E21B 43/126; E21B 43/128; F04B 53/20; F04B 47/06; F04C 13/008; F04D 13/086; F04D 29/046; F04D 29/0413

See application file for complete search history.

(56) References Cited

U.S. PATENT DOCUMENTS 3,677,665 A * 7/1972 Corkill ..... F04C 13/008 418/48

4,553,909 A * 11/1985 Galais ..... F04D 13/10 417/372

(Continued)

FOREIGN PATENT DOCUMENTS

| | | |
|---|---|---|
| JP | 62-32299 | 2/1987 |
| JP | 6-17786 | 1/1994 |

(Continued)

*Primary Examiner* — Nathan C Zollinger

(74) *Attorney, Agent, or Firm* — Wenderoth, Lind & Ponack, L.L.P.

(57) ABSTRACT

An oil field pump is installed within a pipe that connects to an oil field, and feeds accumulated extraction oil in a predetermined direction, the oil filed pump including a rotor with an internal flow path for the extraction oil, a stator installed on the outer circumference of the rotor, a thrust bearing that supports the axial weight of the rotor and the stator, a supply pipe that supplies a portion of the extraction oil in the flow path to the thrust bearing, and a filter that is installed at further upstream on the flow path than the supply pipe along the flow direction of the extraction oil, and traps foreign matter.

6 Claims, 6 Drawing Sheets

(56) References Cited

U.S. PATENT DOCUMENTS

| | | | | |
|---|---|---|---|---|
| 6,015,011 | A * | 1/2000 | Hunter | E21B 43/08 166/227 |
| 10,801,313 | B2 * | 10/2020 | Head | F04D 29/708 |
| 11,199,077 | B2 * | 12/2021 | Yokoyama | F04D 29/061 |
| 2004/0144534 | A1 * | 7/2004 | Lee | E21B 43/128 166/66.4 |
| 2011/0097223 | A1 * | 4/2011 | Verichev | H02K 5/132 210/489 |
| 2018/0149173 | A1 * | 5/2018 | Head | F04D 13/0633 |
| 2020/0340534 | A1 * | 10/2020 | Yu | F16C 33/1055 |
| 2020/0378224 | A1 * | 12/2020 | Yokoyama | F04D 29/061 |
| 2022/0120281 | A1 * | 4/2022 | Mitsuda | F04D 1/06 |
| 2022/0170476 | A1 * | 6/2022 | Mitsuda | F04D 1/08 |

FOREIGN PATENT DOCUMENTS

| | | |
|---|---|---|
| JP | 2016-130491 | 7/2016 |
| JP | 2016-133098 | 7/2016 |

* cited by examiner

OIL FIELD PUMP

CROSS-REFERENCE TO RELATED APPLICATIONS

The present application claims priority to and incorporates by reference the entire contents of Japanese Patent Application No. 2019-102334 filed in Japan on May 31, 2019.

FIELD

The present invention relates to an oil field pump installed in oil fields.

BACKGROUND

Oil fields extract oil by way of oil field equipment including pipes connecting to positions where oil can be extracted and pumps installed within the pipes to feed the oil within the pipes. The pumps are installed within the fluid in the pipes and feed the oil within the pipes to the oil extraction port. The pumps feed oil extracted from oil fields and the fluid therefore sometimes contains foreign matter. The foreign matter mixes in between rotating parts and stationary parts and causes breakdown if the foreign matter accumulates as deposits.

For example, although it is a structure for a sliding bearing, patent literature 1 discloses a vertical pump including a rotating member capable of rotating in water and in air that includes a first slider part on an outer circumferential surface and a second slider part on an inner circumferential surface, a first sliding bearing that supports the first slider part on the inner circumferential surface, a second sliding bearing that supports the second slider part on the outer circumferential surface, and a dust cover that reduces the inflow of foreign matter to the first slider part and the second slider part.

CITATION LIST

Patent Literature

Patent Literature 1: The Japanese Patent Application Laid-open No. 2016-133098 A

SUMMARY

Technical Problem

Here, the oil field pump includes a pump body containing an impeller to compress and feed extraction oil, and a motor that is connected to the pump body and serves as a drive source. The oil field pump further includes a bearing mechanism. Lubricating oil may be supplied to the bearing mechanism by installing supply lines for lubricating oil across the entire area of the pipes or by performing periodic maintenance. In contrast, when lubricating the bearing mechanism with extraction oil, foreign matter might possibly mix into the bearing mechanism of the oil field pump. The device disclosed in patent literature 1 employs a sliding bearing that reduces the effects of the foreign matter but needs further improvement.

To resolve the aforementioned problems with the related art, the present invention has the objective of providing an oil field pump capable of reducing the need for frequent maintenance.

Solution to Problem

To achieve the above object, an oil field pump installed within a pipe that connects to an oil field, the oil field pump being configured to feed accumulated extraction oil in a predetermined direction is disclosed. The oil field pump includes a rotor, a stator mounted on an outer circumference of the rotor, a flow path for flow of the extraction oil that connects an area formed within the rotor to an area formed between the rotor and the stator, a thrust bearing that supports an axial weight of the rotor and the stator, a supply pipe that supplies a portion of the extraction oil in the flow path to the thrust bearing and, a filter that is installed further upstream on the flow path than the supply pipe along a flow direction of the extraction oil, and traps foreign matter.

It is preferable that the supply pipe branches from the flow path, and the filter is installed along the flow direction of the extraction oil in the flow path at a branching position of the flow path and the supply pipe.

It is preferable that the branching position is a junction between the stator and the rotor of the flow path.

It is preferable that the filter is fixed to the stator in a state capable of vibration at further upstream side than the inlet of the flow path for the rotor.

It is preferable that the oil field pump further includes a turbulence generator installed at the inlet of the flow path for the rotor and that generates a turbulent flow in a flow of an operating oil.

It is preferable that the turbulence generator has a blade or vane shape, and installed at a plurality of positions along a rotational direction.

It is preferable that the filter is a plate member formed with through holes penetrating through a thickness direction.

It is preferable that the thrust bearing includes a protrusion part fixed to the outer circumference of the rotor and rotating as one piece with the rotor, and a facing part fixed to the stator and facing opposite a surface of the protrusion part in the axial direction, and the extraction oil is filled between the protrusion part and the facing part.

Advantageous Effects of Invention

The present invention is capable of reducing the need for frequent maintenance.

DESCRIPTION OF EMBODIMENTS

Figure 1:
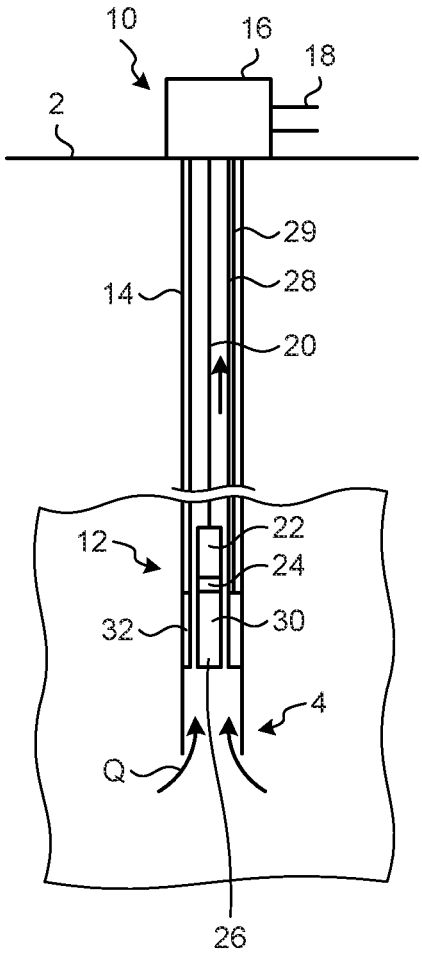
FIG. 1 is an overall structural view of an oil extraction device including an oil field pump of the embodiment of the present invention.

The embodiment of the present invention is described next while referring to the drawings. The present invention is not limited by the embodiment. The structural elements in the following embodiments can be easily substituted by one skilled in the art or may include essentially the same item.

FIG. 1 is an overall structural view of an oil extraction device including an oil field pump of the embodiment of the present invention. An oil extraction device 10 is installed on an installation surface 2. The installation surface 2 is a structure installed at an oil field 4. When the oil field 4 is on the ocean floor or in other words when the oil field 4 is an offshore oil field, the installation surface 2 is a structure at sea level. When the oil field 4 is below ground, the installation surface 2 is a structure at ground level. The oil field 4 is an area to accumulate the extraction oil Q for extraction.

As illustrated in FIG. 1, the oil extraction device 10 includes a pump (oil field pump) 12, a pipe 14, a ground facility 16, and a guide pipe 18. The pump 12 is equipment that feeds the extraction oil Q accumulated in the oil field 4. The extraction oil Q might contain solid matter such as ores in addition to the crude oil. The pipe 14 is a flow path for the internal flow of extraction oil Q. One end of the pipe 14 is installed in the oil field 4 and the other end is connected to the ground facility 16. The pump 12 is installed at a section on the oil field 4 side inside the pipe 14. The ground facility 16 includes a device to wind up a wire 20 such as a coil turbine or a wire winder mechanism described below. The guide pipe 18 guides the extraction oil Q.

Figure 2:
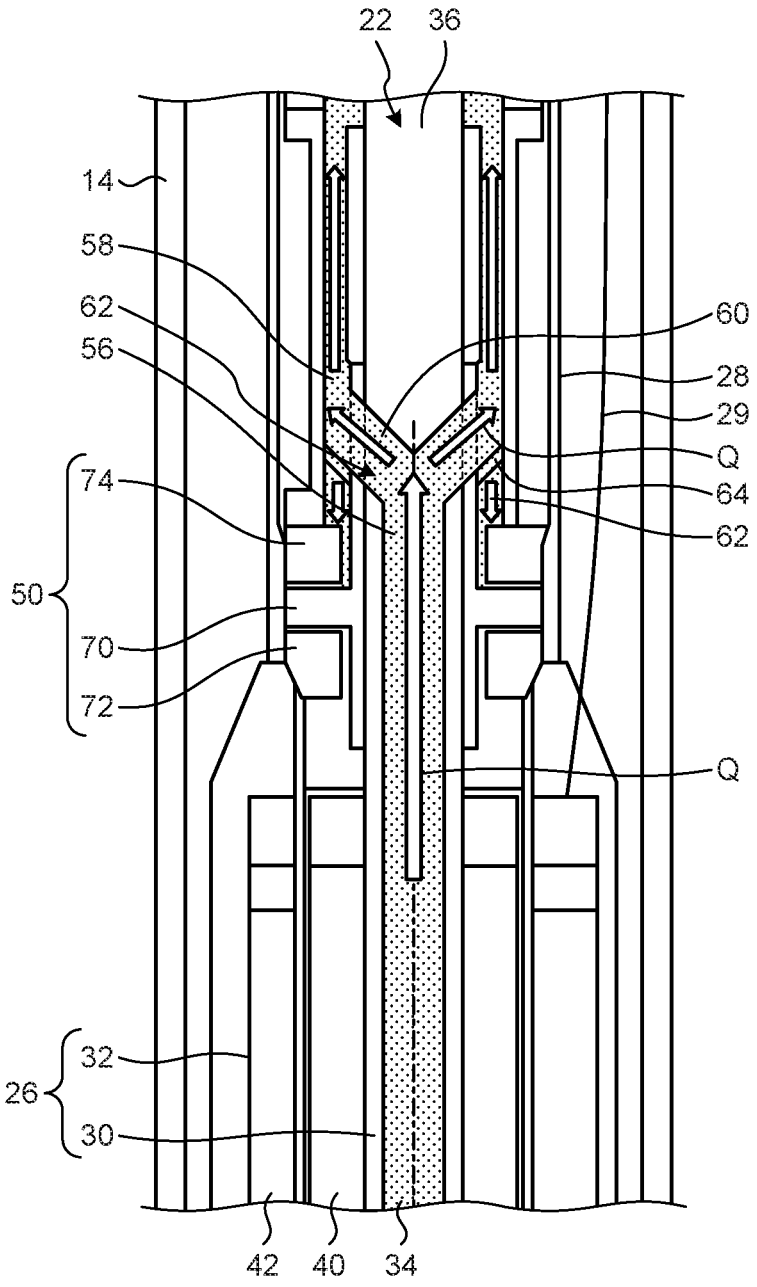
FIG. 2 is a fragmentary cross sectional view of the oil field pump illustrated in FIG. 1.
Figure 3:
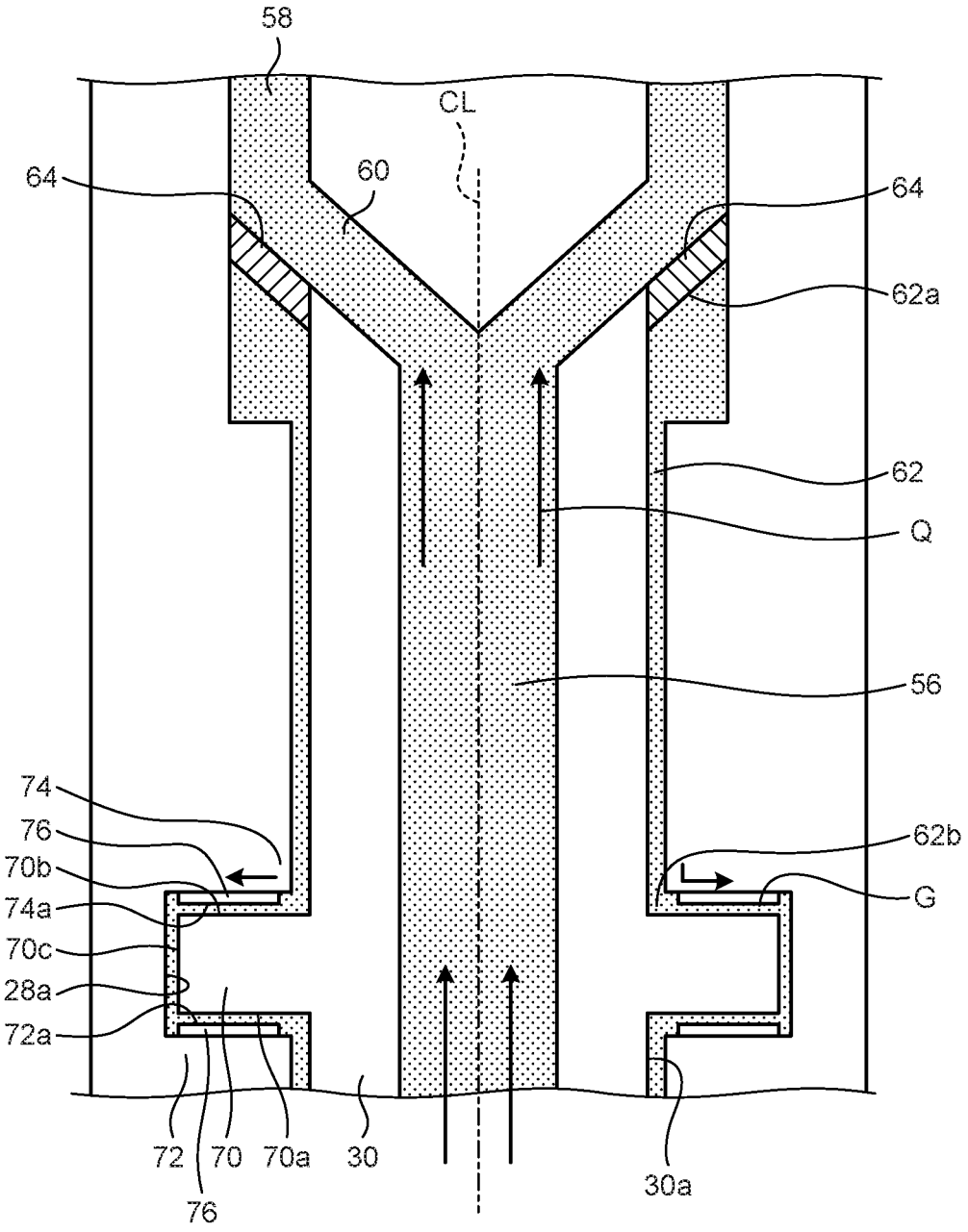
FIG. 3 is a cross-sectional view illustrating one example of the mechanism that supplies extraction oil to a thrust bearing.
Figure 4:
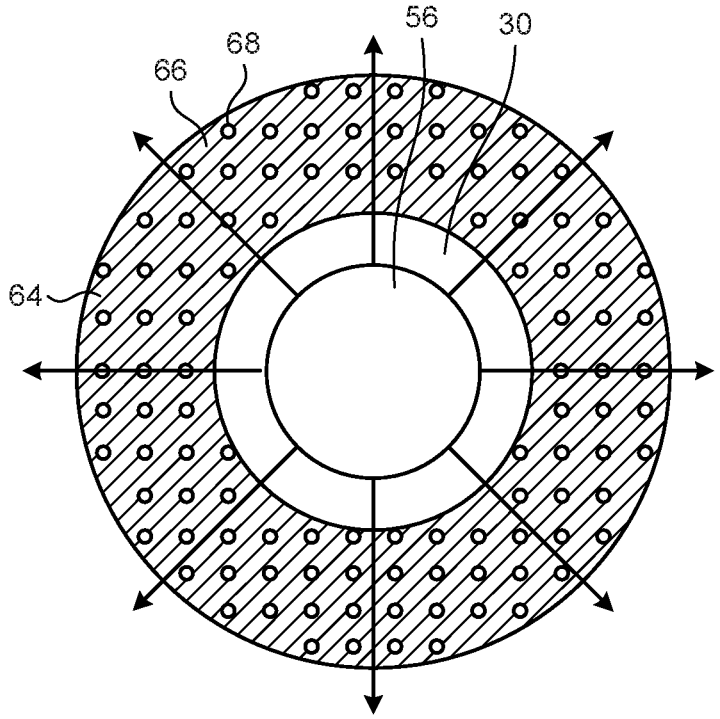
FIG. 4 is a frontal view illustrating the overall structure of a filter.
Figure 5:
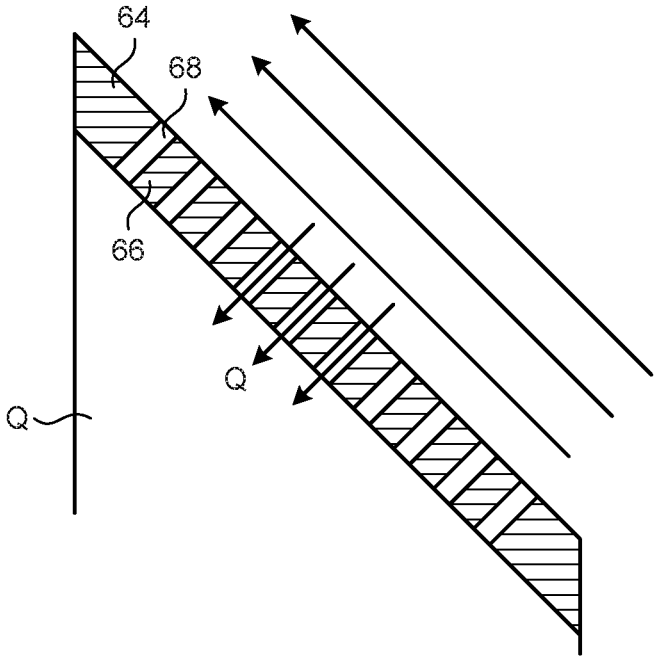
FIG. 5 is a fragmentary enlarged view for describing the function of the filter.

The pump 12 is described next while referring to FIG. 2 through FIG. 5 in addition to FIG. 1. FIG. 2 is fragmentary cross sectional view of the oil field pump illustrated in FIG. 1. FIG. 3 is a cross-sectional view illustrating one example of the mechanism that supplies the extraction oil to the thrust bearing. FIG. 4 is a frontal view illustrating the overall structure of a filter. FIG. 5 is a fragmentary enlarged view for describing the function of the filter. The pump 12 includes the wire 20, a pump body 22, a coupler 24, a motor 26, a stationary pipe 28, an electric cable 29, a thrust bearing 50, a supply pipe 62, and a filter 64.

The pump body 22, the coupler 24, and part of the motor 26 (rotor 30 described below) are integrally connected in the pump 12. The upper end of the pump body 22 connects to the wire 20. The wire 20 can be wound up and fed out by the above described ground facility 16. The stationary pipe 28 fixes a stator 32 that is a portion of the motor 26. The extraction oil Q can flow within the interior of the stationary pipe 28. The electric cable 29 connects between the ground facility 16 and the stator 32 and supplies electrical power to the stator 32.

In the pump 12 of the present embodiment, the pump body 22, the coupler 24, and motor 26, are detachable from the electric cable 29. In other words, winding the wire 20 separates the pump body 22, the coupler 24, and the rotor 30 of the motor 26 as an integrated piece from the stator 32 and raises them upward within the stationary pipe 28. This structure can easily insert and pull up the pump body 22, the coupler 24, and the rotor 30 as an integrated piece so that installing a large scale rig or similar equipment at the installation surface 2 is not necessary.

The motor 26 includes the rotor (rotating part) 30 and the stator (stationary part) 32. The rotor 30 is a cylindrical shape. A flow path 34 for the flow of extraction oil Q therein is formed in the rotor 30. The flow path 34 for the flow of extraction oil Q connects to a flow path of the connecting part 24. In the connecting part 24, flow paths 56, 58 and a branch part 60 are formed as passages for extraction oil Q. The flow path 56 connects to the flow path 34 and the branch part 60. The branch part 60 supplies the extraction oil Q that flows within the rotor 30 to a space between the rotor 20 and the stator 32. The flow path 58 is installed on the upper side perpendicular to the branch part 60, and the internal circumferential surface forms the rotor 30 and the external circumferential surface forms the stator 32. The flow path 58 connects to the flow path of the pump 22.

The rotor 30 can rotate centering on the center axis CL. The rotor 30 includes a permanent magnet 40. The permanent magnet 40 is mounted as one piece with the rotor 30 on the outer circumference of the rotor 30. The stator 32 includes an electromagnet 42. The electromagnet 42 generates a magnetic field from the electrical power supplied from the electric cable 29. The interaction between the magnetic field generated from the electromagnet 40 and the magnetic field generated from the permanent magnet 42 allows rotation of the rotor 30 centering on the center axis CL. An impeller of the pump 22 is mounted on the upper side perpendicular to the rotor 30. Rotation of the rotor 30 rotates the impeller that forms one piece with the rotor 30. The rotation of the impeller compresses and feeds the extraction oil Q on the periphery to the interior of the rotor 30. In other words, the rotor 30 rotates as one piece by the attachment with the rotor (rotating part) of the pump 12. The stator 32 is attached to the stator (stationary part) of the pump 12.

In the coupler 24, the upper end along the central axis of the rotor 30 is inserted into the lower end of the stationary pipe 28. The flow path 56 is connected to the branch part 60 within the stationary pipe 28. The branch part 60 feeds the extraction oil Q flowing upwards perpendicularly within the flow path 34 radially to the outer side.

The thrust bearing 50 includes a protrusion part 70, a retainer part 72 with a facing part 72*a*, and a retainer part 74 including a facing part 74*a*. The protrusion part 70 is fixed to an outer circumference 30*a* of the rotor 30 and rotates as one piece with the rotor 30. The protrusion part 70 is for example a disk shape and includes a first surface 70*a* and a second surface 70*b* mounted on the front and the rear along the axial direction of the center axis CL. In the present embodiment for example, the first surface 70*a* is a surface on the lower side in a perpendicular direction, and the second surface 70*b* is a surface on the upper side in a perpendicular direction. On the retainer parts 72, 74, the bearing pads 76 are mounted on the surface facing the protrusion part 70. The facing part 72*a* and the facing part 74*a* are the surfaces of the bearing pad 76. The bearing pad may be mounted on the first surface 70*a* and the second surface 70*b* of the protrusion part 70.

The retainer parts 72, 74 are members on a ring, and are fixed to the stator of the coupler 24, and in the present embodiment they are fixed to the stationary pipe 28. The retainer parts 72, 74 are attachable and detachable to and from the stationary pipe 28 by way of a tightening mechanism such as screws that attach them to the stationary plate 28. The rotor 30 can in this way be taken out. The facing part 72*a* faces the first surface 70*a* of the protrusion part 70. The facing part 74*a* faces the second surface 70*b* of the protrusion part 70. The protrusion part 70 includes a cylindrical-shaped side surface 70*c* centering on the center axis CL. The side surface 70*c* of the protrusion part 70 faces the inner circumferential surface 28*a* of the stationary pipe 28.

Gaps G filled with lubricating oil are respectively formed between the first surface 70*a* and the facing part 72*a*, the second surface 70*b* and the facing part 74*b*, and the side surface 70*c* and the inner circumferential surface 28*a*. By filling the extraction oil into the gaps G, the thrust bearing 50 can smoothly rotate the rotor 30, and support the axial weight on the center axis CL between the rotor 30 and stator 32. The extraction oil Q that is extracted from the oil field 4 is utilized as the lubricating oil. The structure that supplies the extraction oil Q to the gaps G is described below.

As illustrated in FIG. 2 and FIG. 3, the pump 12 includes the supply pipe 62 that supplies a portion of the extraction oil Q flowing in the flow paths 34, 56, and 58, and the branch part 60 to the thrust bearing 50. The supply pipe 62 is an area enclosed between the rotor 30 and the stator 32 and is a cylindrical-shaped flow path. An extraction port 62*a* at one end of the supply pipe 62 connects to the branch part 60, and a supply port 62*b* at the other end of the supply pipe 62 connects to the gap G of the thrust bearing 50.

The filter 64 is installed at the coupler for the supply pipe 62 and the branch part 60 or specifically at the oil extraction port 62*a* of the supply pipe 62. The filter 64 is installed along the flow direction of the extraction part Q flowing from the branch part 60 towards the flow path 58. In other words, the filter 64 is installed at the branch port 60 side surface, along the wall surface of the flow path of the branch part 60. The filter 64 blocks the extraction oil Q flow path at the installation position of the filter 64, or in other words, blocks the entire surface of the oil extraction port 62*a*. The extraction oil Q passes through the filter 64 at the position that the filter 64 is installed. As illustrated in FIGS. 4 and 5, in the filter 64, a plurality of through-holes 68 are formed in the plate member 66 corresponding to the oil extraction port 62*a*. The plate member 66 has a ring shape and an end on the inner circumferential side connects to the end on the inner circumferential side of the oil extraction port 62*a*, and the end on the outer circumferential side connects to the end on the outer circumferential side of the oil extraction port 62*a*. The through-holes 68 pass through the plate member 66 in the thickness direction. In the present embodiment, the through-holes 68 are holes extending in a direction intersecting the surface of the plate member 66. The through-holes 68 connect the branch part 60 and the supply pipe 62, and form flow paths for the flow of acquisition oil Q. The diameter is smaller than the foreign matter for removal such as ores.

Installing a supply flow path 62 connecting to the branch part 60 of the flow path allows the pump 12 to supply the extraction oil Q to the thrust bearing 50. Lubricating oil can in this way be supplied to the thrust bearing 50 without installing another system to supply lubricating oil. Installing a filter 64 covering the entire installation position on the flow path supplying the extraction oil Q to the thrust bearing 50, allows the pump 12 to supply the extraction oil Q passing through the filter 64 to the thrust bearing 50. The foreign matter in the extraction oil Q for supply to the thrust bearing 50 can in this way be reduced and the life of the thrust bearing 50 can be extended.

The filter 64 is installed along the flow direction of the extraction oil Q flowing from the branch part 60 towards the flow path 58. Here, in the pump 12, the rotor 30 rotates and the branch part 60 has a slope along the radius so that a centrifugal force towards the outer side along the radial direction acts on the extraction oil Q flowing in the branch part 60. The foreign matter (solid material) such as ores contained in the extraction oil Q therefore flow along the branch part 60 by way of this centrifugal force. Therefore, the extraction oil Q flowing from the branch port 60 to the supply pipe 62 attain a state with little solid material content. In this way, the extraction oil Q flowing towards the filter 64 can be supplied in a state with comparatively little solid material compared to the extraction oil Q flowing from the branch port 60 towards the flow path 58. The filter 64 can therefore prevent the occurrences of blockages etc., can extend the life of the filter 64, and can reduce the need for frequent maintenance. Moreover, the forming of a flow of the extraction oil Q along the surface of the filter 64 in the branch part 60, renders the effect that even if solid material builds up (deposits) on the surface of the filter 64, the flow from the branch part 60 moves the solid material from the surface of the filter 64 and can therefore prevent blockages from occurring.

To achieve the above described effects, the filter 64 is preferably installed at the coupler between the supply pipe and the flow path supplying extraction oil to the pump 12. Installing the filter 64 surface at a position facing along the flow of the flow path allows preventing blockages from occurring. In the present embodiment, the supply pipe 62 is connected to the branch part 60, however, the connection position of the supply pipe 62 is not limited to this arrangement. The supply pipe 62 may connect to the flow path 56, or may connect to the flow path 58.

Figure 6:
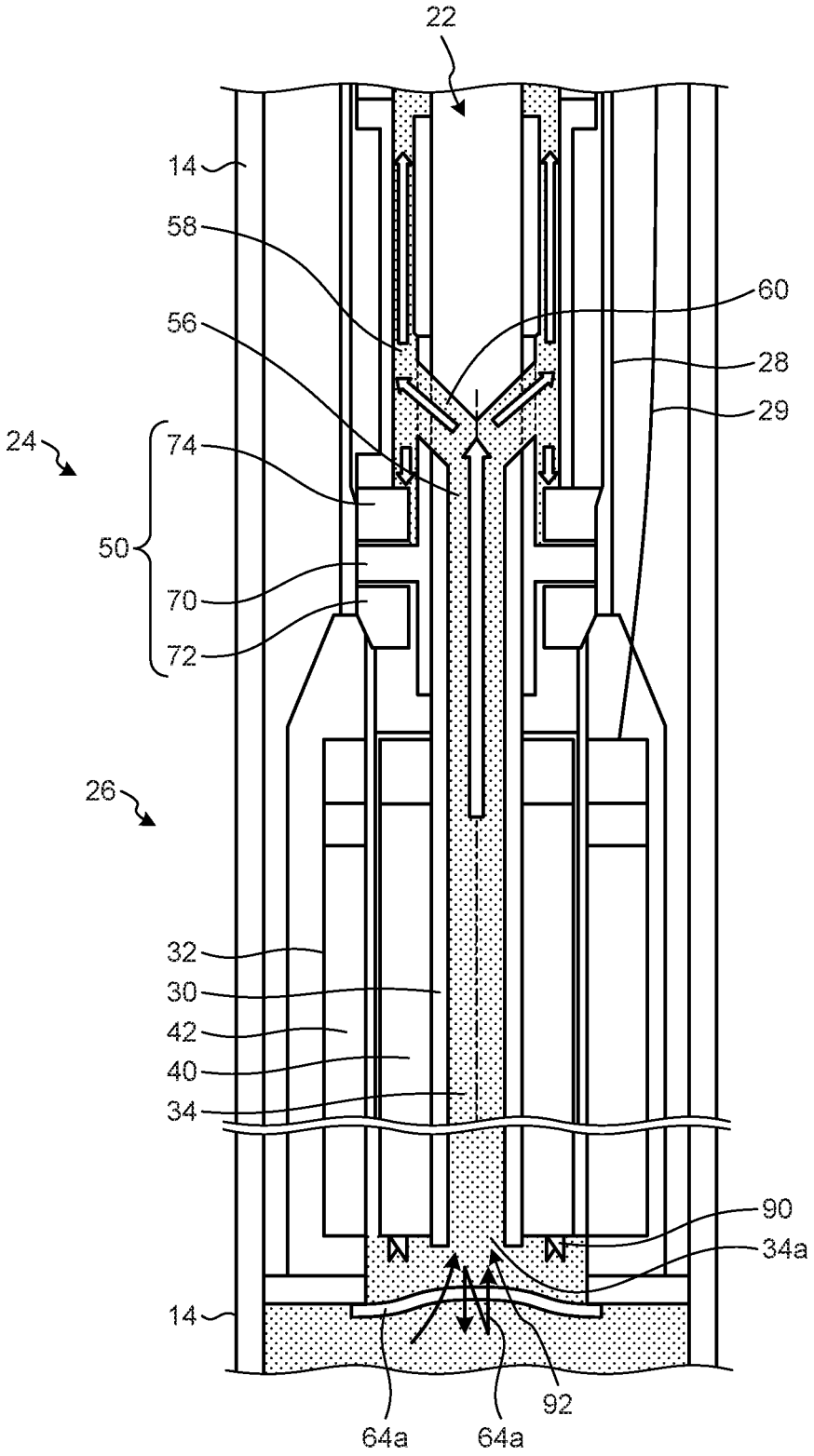
FIG. 6 is a cross sectional view illustrating another example of the mechanism that supplies the extraction oil to a thrust bearing.

Next, FIG. 6 is a cross sectional view illustrating another example of the mechanism that supplies the extraction oil to the thrust bearing. The pump illustrated in FIG. 6 is basically the same structure as the pump 12 illustrated in FIG. 1 through FIG. 5 except for the filter installation position.

The pump illustrated in FIG. 6 includes a filter 64*a*, and a turbulence generator 90. The filter 64*a* is installed at a position to cover the inlet (oil extraction port) 34*a* of the flow path 34 of the motor 26. The filter 64*a* is a concentric plate member, and a junction 92 near the outer edge joins to the stator 32 of the motor 26. Covering the entire opening on the inlet (oil extraction port) 34*a* side of the filter 64*a*, allows the extraction oil Q to flow into the oil extraction port 34*a* after passing through the filter 64*a*. The filter 64*a* traps the solid material and passes the extraction oil Q. As described in the above embodiment, through-holes may be formed in the filter 64*a* to prevent the passage of solid material requiring removal, or fiber-shaped members such as non-woven cloth may be installed asymmetrically as a structure to trap the solid material. In the present embodiment, the junction 92 is joined to the stator 32 in a state allowing vibration of the filter 64*a*. In other words, the length across the junction 92 is longer than the distance across the junction 92 of stator 32, and a portion of the filter 64*a* droops.

The turbulence generator 90 generates a turbulent flow in the extraction oil Q passing through the filter 64*a*. The turbulence generator 90 is installed at the end of the inlet 34*a* side of the rotor 30. The turbulence generator 90 is installed at a plurality of positions along the rotational direction of the rotor 30 and the end shape on the inlet 34*a* side of the rotor 30 is made a non-uniform shape. The turbulence generator 90 of the present embodiment is a vane or blade shape. The turbulence generator 90 generates turbulence in the flow of the extraction oil Q passing through the filter 64*a* by rotating along with the rotor 30.

By installing the filter 64*a*, the pump illustrated in FIG. 6 can trap the solid material contained in the extraction oil Q flowing into the flow path 34 by the filter 64*a*. The solid material contained in the extraction oil Q flowing in the supply pipe 62 from the flow path 34 and supplied to the gaps G of the thrust bearing 50 can in this way be reduced, and the need for frequent maintenance of the thrust bearing 50 can be reduced. The filter 64*a* is fixed to the stator 32 in a state allowing vibration so that the flow of the extraction oil Q can vibrate the filter 64*a*, and the volume of the solid material accumulating onto the filter 64*a* can be reduced. The need for frequent maintenance of the filter 64*a* can in this way be reduced.

In the pump illustrated in FIG. 6, installing the turbulence generator 90 on the rotor 30 near the filter 64*a*, and rotating the turbulence generator 90 along with the rotor 30 can generate satisfactory turbulence via the flow of the extraction oil Q passing through the filter 64*a*. The filter 64*a* can in this way vibrate efficiently. As also described in the above embodiment, by utilizing a turbulence generator 90 with a blade or vane shape, a more effective turbulent flow can be generated. The turbulence generator 90 is not limited to a blade or vane shape, and may protrude axially or may have irregularities (cavities and protrusions). The turbulence generator 90 may also generate turbulence by utilizing a non-uniform structure in the rotational direction.

Figure 7:
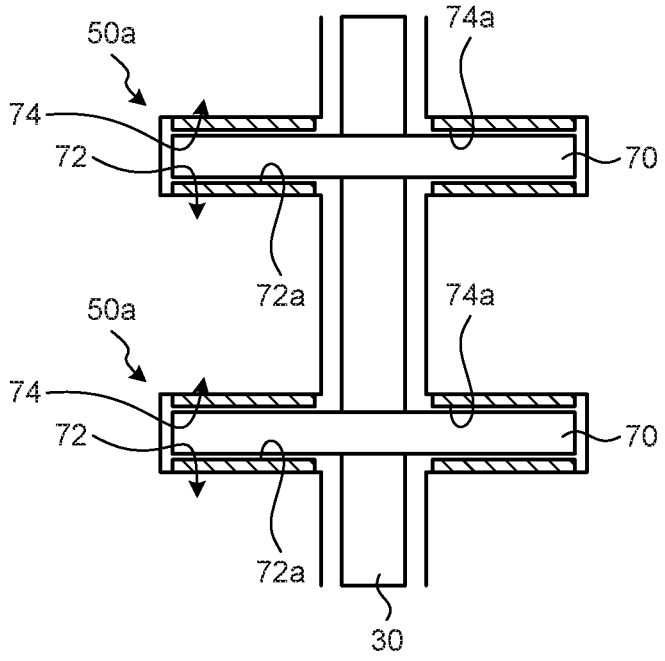
FIG. 7 is an overall structural view illustrating another example of the thrust bearing.

FIG. 7 is an overall structural view illustrating another example of the thrust bearing. As illustrated in FIG. 7, the thrust bearing 50*a* may be formed in multiple steps along the axial direction of the center axis CL. This structure disperses the load on the thrust bearing 50*a* in the axial direction along the center axis CL. Therefore, the surface pressure acting on each single thrust bearing 50*a* is reduced and the gap G can be enlarged. In structures utilizing extraction oil Q containing solid matter as lubricating oil, the bite-in of solid matter among the first surface 70*a*, the second surface 70*b*, and the facing parts 72*a*, 74*a* of the protrusion part 70 is reduced and a long life can be achieved.

Figure 8:
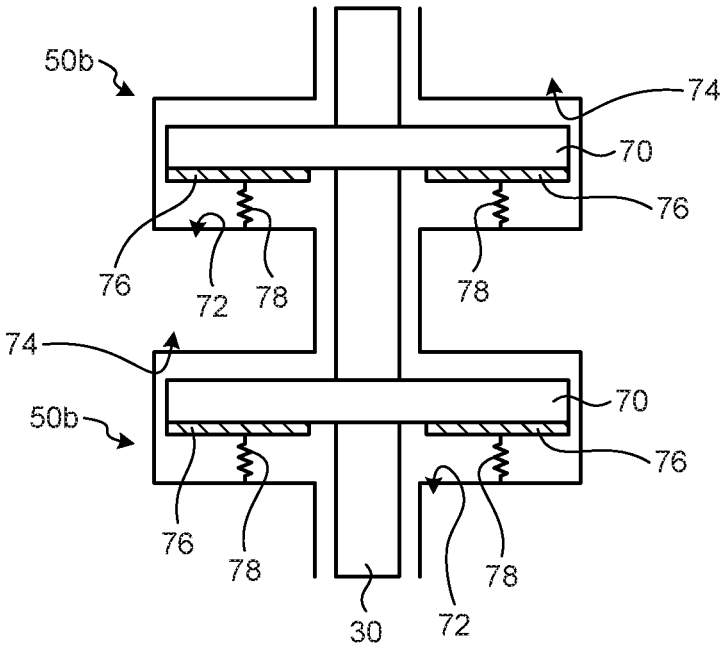
FIG. 8 is an overall structural view illustrating another example of the thrust bearing.

FIG. 8 is an overall structural view illustrating another example of the thrust bearing. As illustrated in FIG. 8, when the thrust bearing 50*b* is formed in multi-stages along the axial direction of the center axis CL, a spring part 78 may be installed between the protrusion part 70 and at least either of the retainer parts 72, 74. The surface pressure acting on each single thrust bearing 50*a* can in this way be a uniform surface pressure. The bearing pads 76 may also be installed on the protrusion part 70.

As illustrated in FIG. 7 and FIG. 8, when multi-stage thrust bearings are installed, the supply pipe 62 may be installed at each protrusion part 70 gap, or may be installed so that the extraction oil Q is supplied to the gap of the next protrusion part after passing the gap of one protrusion part.

The technical scope of the present invention is not limited to the above embodiment and changes in a range not departing from the spirit and scope of the present invention may be added.

REFERENCE SIGNS LIST

2 Installation surface
4 Oil field
10 Oil extraction device
12 Pump
14 Pipe
16 Ground facility
18 Guide pipe
20 Wire
22 Pump body
24 Coupler
26 Motor
28 Stationary pipe
28*a* Inner circumferential surface
29 Electric cable
30 Rotor
30*a* Outer circumference
32 Stator
34, 56, 58 Flow path
40 Permanent magnet
42 Electromagnet
50, 50*a*, 50*b* Thrust bearing
60 Branch part
62 Supply pipe
62*a* Oil extraction port
62*b* Supply port
64, 64*a* Filter
70 Protrusion part
70*a* First surface
70*b* Second surface
70*c* Side surface
72, 74 Retainer part
72*a*, 74*a*, 74*b* Facing part
76 Pad
78 Spring part
90 Turbulence generator
92 Junction
94 Vibrating direction
G Gap
Q Extraction oil

The invention claimed is:

1. An oil field pump installed within a pipe that connects to an oil field, the oil field pump being configured to feed accumulated extraction oil in a predetermined direction, the oil field pump comprising:

a rotor;

a stator mounted on an outer circumference of the rotor;

a flow path for flow of the extraction oil, the flow path connecting a first area formed within the rotor to a second area formed between the rotor and the stator, the first area being upstream of the second area with respect to a flow direction of the extraction oil along the flow path;

a thrust bearing that supports an axial weight of the rotor;

a supply pipe that supplies a portion of the extraction oil in the flow path to the thrust bearing; and a filter that is installed farther upstream on the flow path than the supply pipe and traps foreign matter, wherein the filter is a circular plate fixed to the stator so as to be capable of vibration, and wherein the filter is arranged farther upstream than an inlet of the first area, and is arranged such that a surface of the filter which faces the inlet of the first area covers an entire opening of the pump.

2. The oil field pump according to claim 1, wherein the supply pipe branches from the flow path at a branching position.

3. The oil field pump according to claim 2, wherein the branching position is a coupler between the stator and the rotor of the flow path.

4. The oil field pump according to claim 1, further comprising a turbulence generator installed at the inlet of the first area and that generates a turbulent flow in a flow of the extraction oil, wherein the turbulence generator has a blade or vane shape, and is installed at a plurality of positions along a rotational direction.

5. The oil field pump according to claim 1, wherein the filter is formed with through holes penetrating through a thickness direction of the circular plate.

6. The oil field pump according to claim 1, wherein the thrust bearing includes a protrusion part fixed to the outer circumference of the rotor and rotating as one piece with the rotor, and a facing part fixed to the stator and facing opposite a surface of the protrusion part in the axial direction, and the extraction oil is filled between the protrusion part and the facing part.

* * * * *